US005835827A

United States Patent [19]

Kishimoto

[11] Patent Number: 5,835,827

[45] Date of Patent: Nov. 10, 1998

[54] STIRRER AND TONER CARTRIDGE EQUIPPED WITH THE STIRRER

[75] Inventor: Teruki Kishimoto, Osaka, Japan

[73] Assignee: Mita Industrial Co., Ltd., Osaka, Japan

[21] Appl. No.: 878,066

[22] Filed: Jun. 18, 1997

[30] Foreign Application Priority Data

Jul. 4, 1996 [JP] Japan ..... 8-174549

[51] Int. Cl.[6] ..... G03G 15/08

[52] U.S. Cl. ..... 399/254; 399/263; 366/313; 366/326.1

[58] Field of Search ..... 399/254, 255, 399/256, 263; 366/312, 313, 326.1, 325.9, 325.92, 325.93, 329.3

[56] References Cited

U.S. PATENT DOCUMENTS 5,202,732 4/1993 Yahata ..... 399/263

FOREIGN PATENT DOCUMENTS 4-319975 11/1992 Japan .
9-62072 3/1997 Japan .

*Primary Examiner*—Joan H. Pendegrass
*Attorney, Agent, or Firm*—Beveridge, DeGrandi, Weilacher & Young, L.L.P.

[57] ABSTRACT

A toner cartridge including a container having a toner discharge port, a toner contained in the container and a stirrer for stirring the toner existing in the container. The stirrer includes a rotary shaft rotatably mounted between both side walls of the container, not less than two arms extending in the radial direction, from the rotary shaft at fixed intervals in the axial direction and not less than one paddle disposed between the ends of the arms. Each paddle has a plate piece made of a synthetic resin film extending in a direction to separate away from the rotary shaft. The plate piece has one or more holes formed therein.

14 Claims, 4 Drawing Sheets

STIRRER AND TONER CARTRIDGE EQUIPPED WITH THE STIRRER

FIELD OF THE INVENTION

The present invention relates to a stirrer for stirring powder such as toner and to a toner cartridge equipped with such a stirrer.

DESCRIPTION OF THE PRIOR ART

In electrostatic copiers, electrostatic printers and electrostatic facsimiles, an electrostatic latent image is formed on an electrostatic photosensitive material and is then developed into a toner image. A developing device for developing the electrostatic latent image into the toner image comprises a developing housing that accommodates a so-called one-component developing agent consisting of the toner only or a so-called two-components developing agent consisting of the toner and carrier particles, a developing agent application means for conveying the developing agent accommodated in the developing housing to a developing zone to apply it to the electrostatic photosensitive material, and a toner replenishing means for replenishing the developing housing with the toner. The toner replenishing means usually includes a toner cartridge which is detachably attached. A typical toner cartridge includes a container having a toner discharge port, a toner contained in the container and a stirrer which stirs the toner existing in the container to prevent it from being agglomerated. In many cases, the stirrer has a function for conveying the toner in a required direction in addition to a function for stirring the toner. The above stirrer is constituted by a rotary shaft which is rotatably mounted across both side walls of the container, a plurality of arms extending in the radial direction from the rotary shaft at intervals in the axial direction, a plurality of paddles disposed between the arms, and plate pieces made of a synthetic resin film arranged on the paddles and extending from the paddles toward directions to separate away from the rotary shaft. The paddles are arranged at positions of a single angle or at positions of two angles which are different from each other by 180 degrees. One end of the rotary shaft of the stirrer outwardly protrudes beyond the side wall of the container, and an input gear is attached to the protruding end. When the toner cartridge is mounted on a required position of the developing device, the input gear attached to the rotary shaft of the stirrer is drivably coupled to an electric motor via a transmission gear train, whereby the rotary shaft of the stirrer, arms and paddles are driven by the electric motor.

The above-mentioned conventional toner cartridge, however, involves a problem that must be solved as described below. That is, masses of toner in the container must be stirred and conveyed by driving the rotary shaft of the stirrer, arms, paddles and plate pieces by using an electric motor, and for this purpose a considerably large maximum torque is required. In other words, a relatively expensive electric motor must be used to produce a large output torque and, besides, the stirrer must be designed to possess a relatively high strength.

SUMMARY OF THE INVENTION

A first object of the present invention is to provide a novel and improved stirrer which can considerably decrease a maximum rotational torque compared with that of the conventional stirrers but without causing the plate pieces to produce a decreased stirring action on the powder such as toner.

A second object of the present invention is to provide a novel and improved toner cartridge which can considerably decrease a maximum rotational torque compared with that of the conventional toner cartridges but without causing the plate pieces to produce a decreased stirring action on the toner.

According to a first aspect of the present invention, there is provided a stirrer comprising a rotary shaft, at least two arms extending in the radial direction from said rotary shaft at a distance in the axial direction, and at least one paddle arranged between the ends of said arms, said paddle being provided with a plate piece made of a synthetic resin film extending from said paddle in a direction to separate away from said rotary shaft, wherein said plate piece has at least one hole formed therein.

According to a second aspect of the present invention, there is provided a toner cartridge comprising a container having a toner discharge port, a toner contained in said container, and a stirrer for stirring the toner present in said container, said stirrer including a rotary shaft rotatably mounted across both side walls of said container, at least two arms extending in the radial direction from said rotary shaft at a distance in the axial direction, and at least one paddle arranged between the ends of said arms, said paddle being provided with a plate piece made of a synthetic resin film extending from said paddle in a direction to separate away from said rotary shaft, wherein said plate piece has at least one hole formed therein.

According to the present invention, the plate piece disposed on the paddle has at least one hole (through hole) formed therein. When the rotary shaft, arms, paddles and plate pieces of the stirrer are driven by the electric motor, the holes in the plate pieces permit the passage of the powder such as toner, contributing to considerably decreasing a maximum required rotational torque compared with that of the conventional stirrers. Besides, the holes in the plate pieces work to loosen the masses of powder as the powder passes therethrough and, hence, the plate pieces exhibit improved stirring ability.

It is desired that the holes are formed in a number of two in the plate piece at a distance in the width direction thereof. In the present invention, since two holes are formed in the plate piece, further improved function for loosening the masses of powder can be obtained. Besides, a portion existing between the holes of the plate piece to define a distance therebetween works to support the plate piece, preventing the plate piece from losing resiliency.

It is desired that the paddles are arranged in a number of more than three in a dispersed manner at least at three angular positions different from each other at intervals in the circumferential direction. According to the present invention, the amount of change in the torque for rotating the stirrer one turn is considerably smaller than that of the conventional stirrer in which the paddles are arranged in a concentrated manner at a single position or at two angular positions, and a maximum required torque can be decreased to a considerably small degree. Besides, since the effectively acting areas of the paddles for the powder are not decreased, the action for stirring and conveying the powder are not decreased.

DETAILED DESCRIPTION OF THE PREFERRED EMBODIMENTS

The invention will now be described in further detail with reference to the accompanying drawings which illustrate preferred embodiments of a toner cartridge of the invention.

Figure 1:
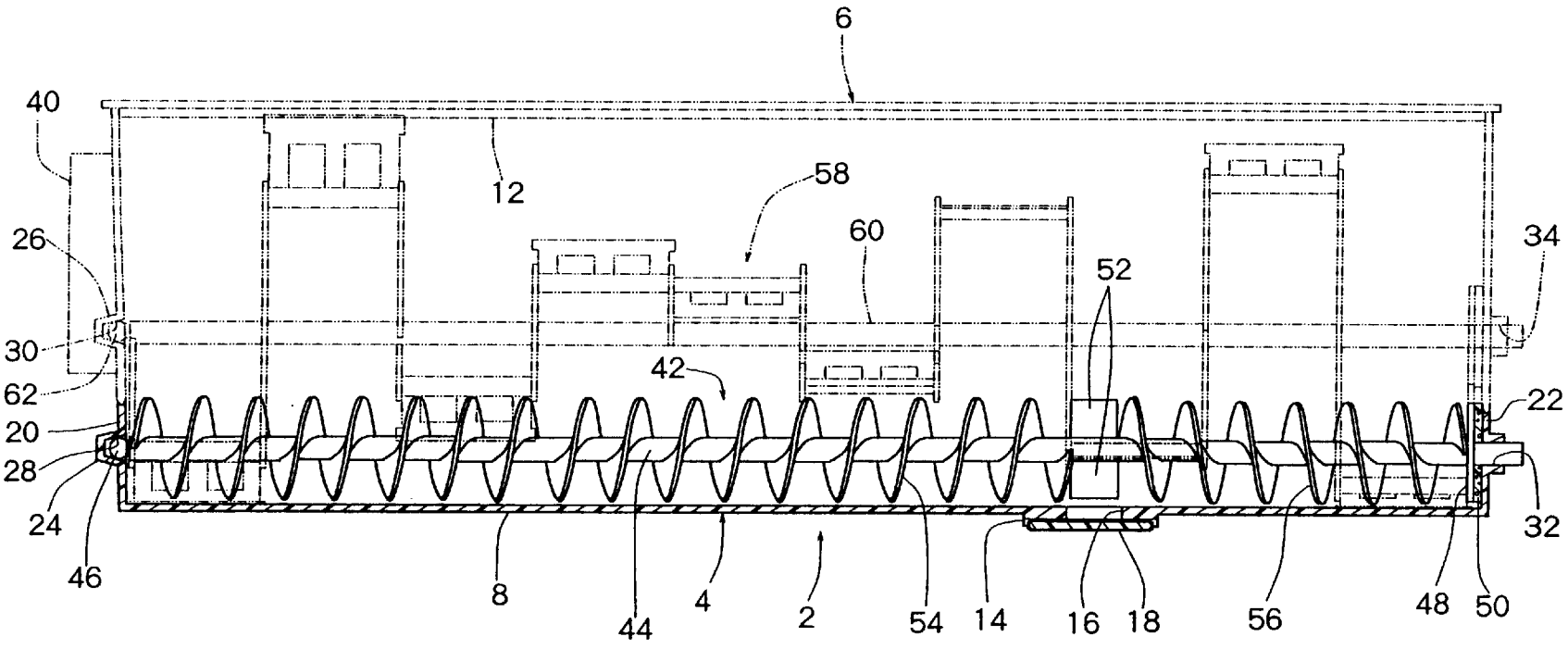
FIG. 1 is a sectional view in the axial direction of a toner cartridge constituted according to a preferred embodiment of the present invention but omitting the toner contained in a container.
Figure 2:
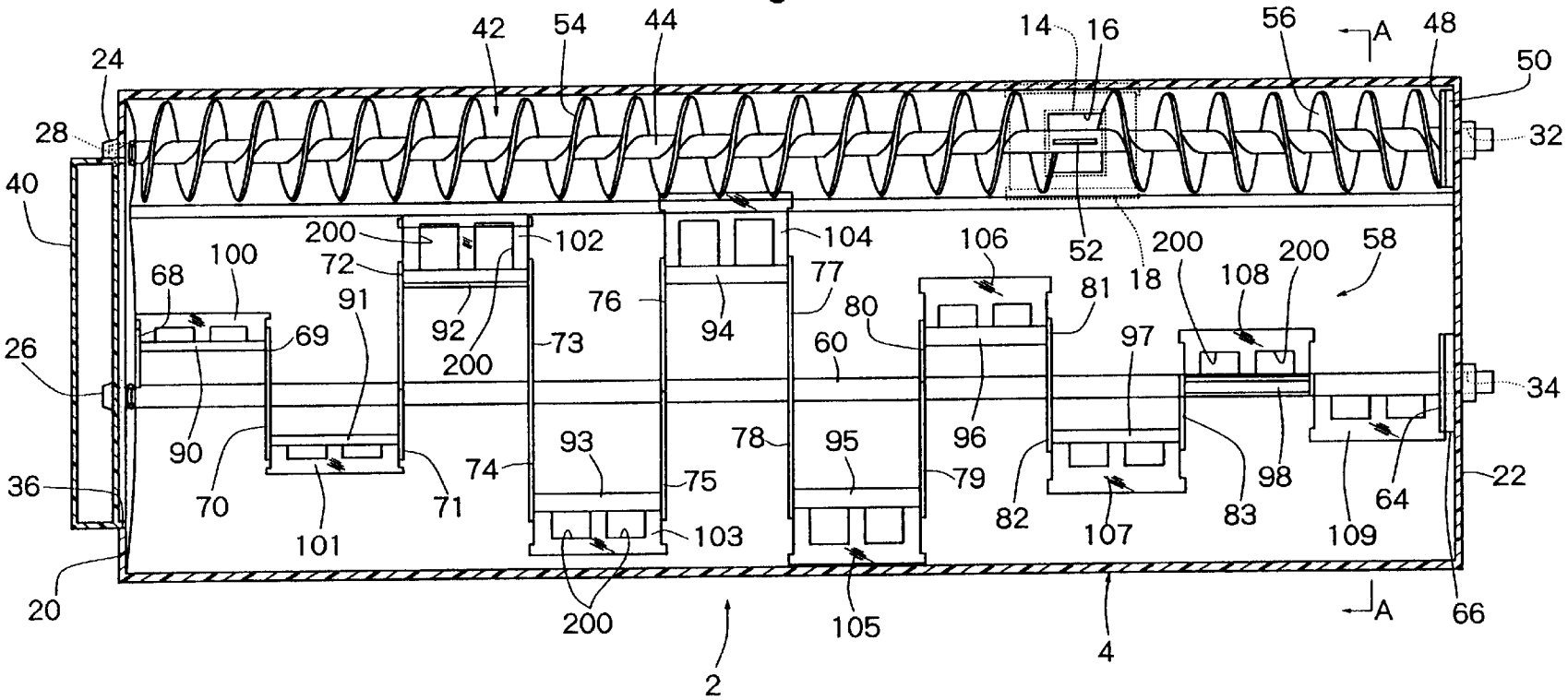
FIG. 2 is a plan view illustrating the toner cartridge shown in FIG. 1 but omitting an upper closure of the container and the toner contained in the container.
Figure 3:
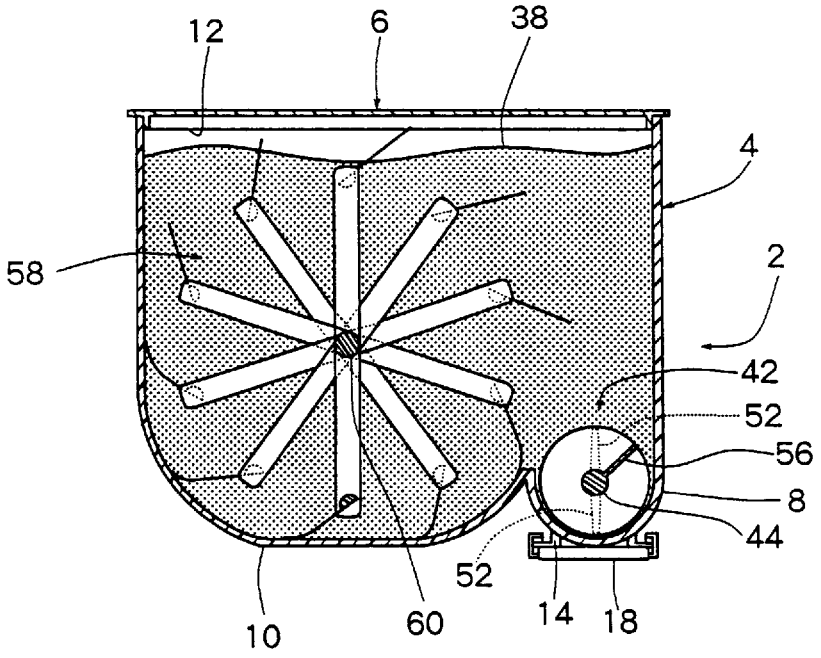
FIG. 3 is a transverse sectional view along the line A—A of FIG. 2.

With reference to FIGS. 1 to 3, the illustrated toner cartridge is equipped with a container that is generally designated at 2. The container 2 is constituted by a main member 4 and a closure member 6. The main member 4 that can be made of a suitable synthetic resin has the shape of a box with its upper surface open. As will be clearly comprehended with reference to FIG. 3, the bottom wall of the main member 4 comprises two portions 8 and 10 arranged in parallel in the transverse sectional view. The portion 8 of one side is defined by a relatively small arcuate portion. The portion 10 of the other side is defined by a linear central portion that extends substantially horizontally and by arcuate portions positioned on both sides thereof. The closure member 6 which can similarly be made of a suitable synthetic resin has the shape of a flat plate and has on the lower surface thereof a protrusion 12 of a shape corresponding to a rectangular opening formed in the upper surface of the main member 4. The closure member 6 is positioned on the upper surface of the main member 4 with its protrusion 12 protruding inwardly of the main member 4, and is secured to the main member 4 by a suitable method such as ultrasonic welding to close the upper surface of the main member 4. In the arcuate portion 8 of the bottom wall is formed a downwardly protruding rectangular mouth portion 14 in which is formed a toner discharge port 16. The mouth portion 14 is equipped with a shutter member 18 which slides between a close position to close the toner discharge port 16 and an open position to open the toner discharge port 16 (the shutter member 18 may be constituted in a known form and its details are not described in this specification).

The main member 4 of the container 2 has both side walls 20 and 22. Two protruding portions 24 and 26 are formed on one side wall 20, and blind holes 28 and 30 are defined on the inside of the protruding portions 24 and 26. The blind holes 28 and 30 have the shape of a circular truncated cone with their inner diameter gradually increasing inwardly. In the other side wall 22 are formed through holes 32 and 34 that correspond respectively to the blind holes 28 and 30. The blind hole 28 and the through hole 32 are positioned on the center line of curvature of the arcuate portion 8 on the bottom wall. The other blind hole 30 and the other through hole 34 are positioned on an axis that passes through nearly the center of an upper space of the portion 10 of one side of the bottom wall.

In the side wall 20 is further formed a relatively large circular opening 36 (FIG. 2). Through the opening 36, the container 2 is filled with a toner 38 in a required amount (FIG. 3). After the container is filled with the toner 38, a closing member 40 is fitted to the side wall 20 by welding, bonding or the like to thereby close the opening 36.

With further reference to FIGS. 1 to 3, the container 2 contains a toner conveyer 42 arranged on the arcuate portion 8 of the bottom wall. The conveyer 42 includes a rotary shaft 44. As clearly shown in FIG. 1, one end 46 of the rotary shaft 44 is of a nearly spherical shape having a diameter which lies between a minimum inner diameter and a maximum inner diameter of the blind hole 28. Near the other end of the rotary shaft 44 is formed a circular flange 48. Furthermore, an annular sealing member 50 is fitted to the rotary shaft 44 on the outer side of the circular flange 48. The sealing member 50 may be made of a soft sponge. The rotary shaft 44 is inserted, at its nearly spherically shaped one end 46, in the blind hole 28 formed in the side wall 20 of the container 2 as shown in FIG. 1 and the whole rotary shaft 44 being elastically deformed to some extent is passed, at its other end, through the hole 32 formed in the side wall 22 of the container 22, whereby it is allowed to be rotatably mounted between the side walls 20 and 22. As will be easily comprehended with reference to FIG. 1, the blind hole 28 has the shape of a circular truncated cone, and the one end 46 of the rotary shaft 44 is nearly of a spherical shape. Therefore, the outer peripheral surface of the one end 46 of the rotary shaft 44 is brought into line contact, instead of surface contact, with the inner peripheral surface of the blind hole 28 irrespective of some machining error and, hence, excess rotational resistance is never created by the frictional contact between the blind hole 28 and the one end 46 of the rotary shaft 44. When the other end of the rotary shaft 44 is passed through the hole 32, the circular flange 48 is positioned close to the inner surface of the side wall 22, the sealing member 50 is compressed to some extent between the circular flange 48 and the side wall 22. Thus, the sealing member 50 prevents the toner 38 from leaking out of the container through the hole 32. The other end of the rotary shaft 44 protrudes outwardly penetrating through the side wall 22, and an input gear (not shown) is fitted to the protruded end. When the toner cartridge is mounted on a required position of a developing device (not shown), the input gear is coupled to an electric motor (not shown) via a transmission gear train (not shown). When the electric motor is energized, the rotary shaft 44 is rotated in the clockwise direction in FIG. 3. As will be comprehended with reference to FIGS. 1 and 2, on the rotary shaft 44 are formed a pair of discharge vanes 52 and spiral vanes 54, 56. The pair of discharge vanes 52 are plate pieces which protrude in a radial direction from the rotary shaft 44 at an angular distance of 180 degrees relative to each other, and are located above a toner discharge port 16 formed in the arcuate portion 8 of the bottom wall. The spiral vane 54 extends between the side wall 20 and the discharge vanes 52, while the spiral vane 56 extends between the side wall 22 and the discharge vanes 52. The spiral direction of the spiral vane 54 is opposite to the spiral direction of the spiral vane 56. When the rotary shaft 44 rotates in the clockwise direction in FIG. 3, the spiral vane 54 carries the toner 38 rightwardly toward the discharge vanes 52 in FIGS. 1 and 2, and the spiral vane 56 carries the toner 38 leftwardly toward the discharge vanes 52 in FIGS. 1 and 2. The discharge vanes 52 cause the toner 38 to fall down from the container 2 through the toner discharge port 16 that is opened. Thus, the toner 38 is supplied from the toner cartridge to the developing device (not shown). It is desired that the rotary shaft 44, flange 48, discharge vanes 52 and spiral vanes 54, 56 of the toner conveyer mechanism 42 are molded as a unitary structure using a suitable synthetic resin. Thus, the resilient deformation is relatively easily accomplished in the assembling operation in which one end of the rotary shaft 44 is inserted in the blind hole 28 and the other end thereof is inserted in the through hole 32, contributing to facilitating the assembling operation.

The container 2 further contains a stirrer 58 located on the portion 10 of the other side of the bottom wall. With reference to FIG. 2 as well as FIGS. 4 and 5, the stirrer 58 includes a rotary shaft 60. One end 62, too, of the rotary shaft 60 is formed in a nearly spherical shape like the one end of the rotary shaft 48 of the conveyer 42, and has a diameter which lies between a minimum inner diameter and a maximum inner diameter of the blind hole 30. A circular flange 64 is formed near the other end of the rotary shaft 60, and an annular sealing member 66 is fitted to the rotary shaft 60 on the outer side of the circular flange 64. The sealing member 66 may be made of a soft sponge or a synthetic rubber. The rotary shaft 60 is inserted, at its nearly spherically shaped one end 62, in the blind hole 30 formed in the side wall 20 of the container 2 like the rotary shaft 44 of the conveyer 42 and is passed, at its other end, through the hole 34 formed in the side wall 22 of the container 2, the whole rotary shaft 60 being elastically deformed to some extent, whereby it is allowed to be rotatably mounted between the side walls 20 and 22. Like that of the relationship between the one end 46 of the rotary shaft 44 and the blind hole 28 shown in FIG. 1, the blind hole 30 has the shape of a circular truncated cone, and the one end 62 of the rotary shaft 60 is nearly of a spherical shape. Therefore, the outer peripheral surface of the one end 62 of the rotary shaft 60 is brought into line contact, instead of surface contact, with the inner peripheral surface of the blind hole 30 irrespective of some machining error and, hence, excess rotational resistance is never created by the frictional contact between the blind hole 30 and the one end 62 of the rotary shaft 60. When the other end of the rotary shaft 60 is passed through the hole 34, the circular flange 64 is positioned close to the inner surface of the side wall 22, and the sealing member 66 is compressed to some extent between the circular flange 64 and the side wall 22. Thus, the sealing member 66 prevents the toner 38 from leaking out of the container through the hole 34. The other end of the rotary shaft 60 protrudes outwardly penetrating through the side wall 22, and an input gear (not shown) is fitted to the protruded end. The input gear engages with a gear (not shown) fitted to the protruded end of the rotary shaft 44 of the conveyer 42. When the electric motor is energized to rotate the rotary shaft 44 of the conveyer 42 in the clockwise direction in FIG. 3, the rotary shaft 60 of the stirrer 58 rotates in the clockwise direction in FIG. 3.

Figure 5:
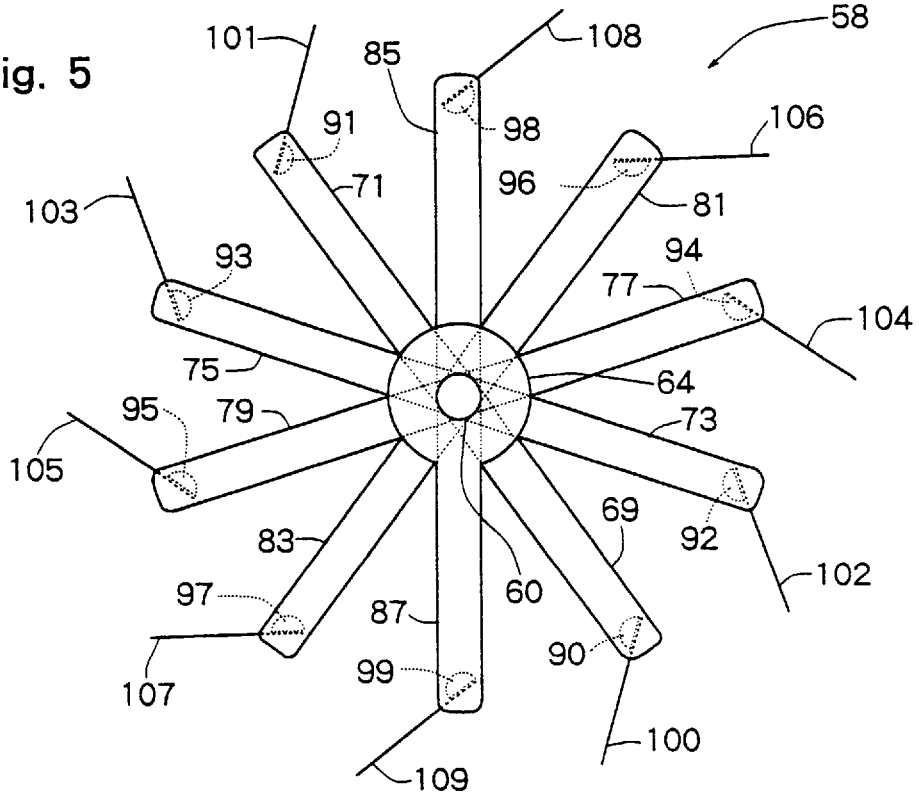
FIG. 5 is a side view illustrating the stirrer in the toner cartridge shown in FIG. 1.
Figure 4:
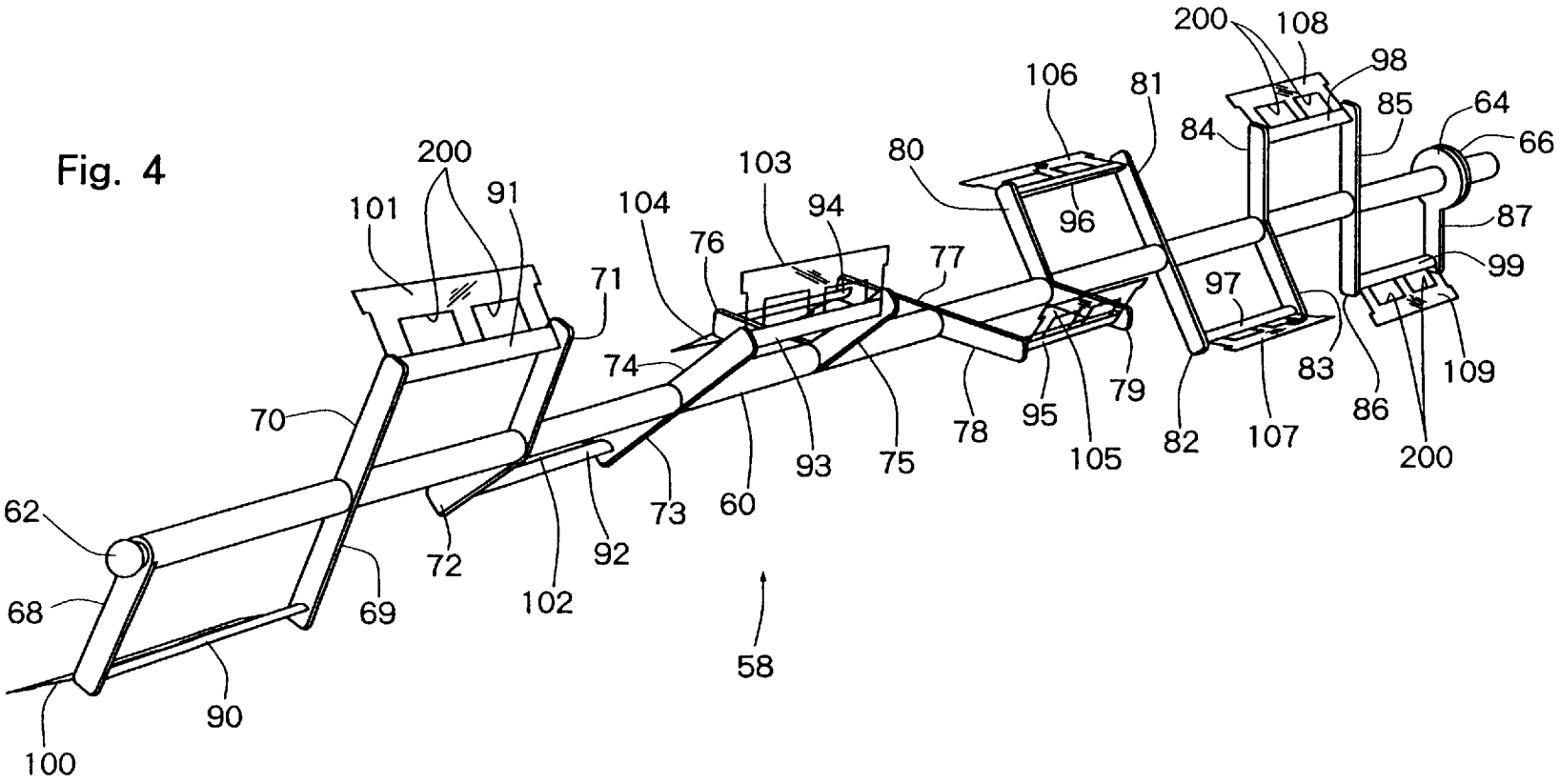
FIG. 4 is a perspective view illustrating a stirrer in the toner cartridge shown in FIG. 1.

With reference to FIG. 2 as well as FIGS. 4 and 5, on the rotary shaft 60 of the stirrer 58 are arranged twenty arms 68, 69, 70, 71, 72, 73, 74, 75, 76, 77, 78, 79, 80, 81, 82, 83, 84, 85, 86 and 87, at equal intervals, in the axial direction. The arms 68 to 86 extend in the radial direction from the outer peripheral surface of the rotary shaft 60, but the arm 87 extends in the radial direction from the outer peripheral edge of a circular flange 64 formed on the rotary shaft 60. The arms 68 and 69 are located at the same angular position, and a paddle 90 is disposed between the ends of the arms 68 and 69. The arms 70 and 71 are located at the same angular position, and a paddle 91 is disposed between the ends of the arms 70 and 71. The arms 70 and 71 are located at positions at an angular distance of 180 degrees with respect to the arms 68 and 69. Therefore, the paddle 91 is disposed at an angular distance of 180 degrees with respect to the paddle 90. The arms 72 and 73 are located at the same angular position, and a paddle 92 is disposed between the ends of the arms 72 and 73. The arms 72 and 73 are located at an angular distance of 36 degrees with respect to the arms 68 and 69 in the counterclockwise direction in FIG. 5. Therefore, the paddle 92 is disposed at an angular distance of 36 degrees with respect to the paddle 90 in the counterclockwise direction in FIG. 5. The arms 74 and 75 are located at the same angular position, and a paddle 93 is disposed between the ends of the arms 74 and 75. The arms 74 and 75 are located at positions at an angular distance of 180 degrees with respect to the arms 72 and 73. Therefore, the paddle 93 is disposed at an angular distance of 180 degrees with respect to the paddle 92. The arms 76 and 77 are located at the same angular position, and a paddle 94 is disposed between the ends of the arms 76 and 77. The arms 76 and 77 are located at an angular distance of 36 degrees with respect to the arms 72 and 73 in the counterclockwise direction in FIG. 5. Therefore, the paddle 94 is disposed at an angular distance of 36 degrees with respect to the paddle 92 in the counterclockwise direction in FIG. 5. The arms 78 and 79 are located at the same angular position, and a paddle 95 is disposed between the ends of the arms 78 and 79. The arms 78 and 79 are located at positions at an angular distance of 180 degrees with respect to the arms 76 and 77. Therefore, the paddle 95 is disposed at an angular distance of 180 degrees with respect to the paddle 94. The arms 80 and 81 are located at the same angular position, and a paddle 96 is disposed between the ends of the arms 80 and 81. The arms 80 and 81 are located at an angular distance of 36 degrees with respect to the arms 76 and 77 in the counterclockwise direction in FIG. 5. Therefore, the paddle 96 is disposed at an angular distance of 36 degrees with respect to the paddle 94 in the counterclockwise direction in FIG. 5. The arms 82 and 83 are located at the same angular position, and a paddle 97 is disposed between the ends of the arms 82 and 83. The arms 82 and 83 are located at positions at an angular distance of 180 degrees with respect to the arms 80 and 81. Therefore, the paddle 97 is disposed at an angular distance of 180 degrees with respect to the paddle 96. The arms 84 and 85 are located at the same angular position, and a paddle 98 is disposed between the ends of the arms 84 and 85. The arms 84 and 85 are located at an angular distance of 36 degrees with respect to the arms 80 and 81 in the counterclockwise direction in FIG. 5. Therefore, the paddle 98 is disposed at an angular distance of 36 degrees with respect to the paddle 96 in the counterclockwise direction in FIG. 5. The arms 86 and 87 are located at the same angular position, and a paddle 99 is disposed between the ends of the arms 86 and 87. The arms 86 and 87 are located at positions at an angular distance of 180 degrees with respect to the arms 84 and 85. Therefore, the paddle 99 is disposed at an angular distance of 180 degrees with respect to the paddle 98. Thus, the paddles 90 to 99 are successively disposed at an angular distance of 36 degrees.

The distance from the center axis of the rotary shaft 60 to each of the ends of the arms 68 to 87 is substantially the same. The paddles 90 to 99 extend substantially in parallel with the rotary shaft 60 and have substantially the same length. The distance between each of the paddles 90 to 99 and the rotary shaft 60 is substantially the same. The paddles 90 to 99 have a semicircular shape in transverse section and are so arranged that a flat surface is located nearly horizontally and faces upwards when they are brought to an angular position where the paddle 96 locates in FIG. 5.

It is desired that the rotary shaft 60, flange 64, arms 68 to 87 and paddles 90 to 99 of the stirrer 58 are molded as a unitary structure using a suitable synthetic resin.

Thus, the resilient deformation is relatively easily accomplished in the assembling operation in which one end of the rotary shaft 60 is inserted in the blind hole 30 and the other end thereof is inserted in the through hole 34, contributing to facilitating the assembling operation.

With reference to FIGS. 2 and 4, the paddles 90, 91, 92, 93, 94, 95, 96, 97, 98 and 99 of the stirrer 58 are provided with plate pieces 100, 101, 102, 103, 104, 105, 106, 107, 108 and 109, respectively. The plate pieces 100 to 109 are made of a suitable synthetic resin film such as polyethylene terephthalate film. The plate pieces 100 to 109 extend from the base portions where they are fitted to the flat surfaces of the paddles 90 to 99 by a suitable method such as bonding in a direction to separate away from the rotary shaft 60 in parallel with the flat surfaces of the paddles 90 to 99. The main portions of the plate pieces 100 to 109 have a width (in the axial direction of the rotary shaft 60) which is substantially equal to the length of the paddles 90 to 99. Here, the plate pieces 100 to 109 have at the ends thereof a pair of protruding portions protruding toward both sides thereof. The length of the protruding portions is slightly larger than the thickness of the arms 68 to 87, which support the paddles 90 to 98.

Each of the plate pieces 100 to 109 has two holes 200 of substantially the same rectangular shape. The holes 200 are formed in the main portions of the plate pieces 100 to 109 at a distance in the width direction thereof (in the axial direction of the rotary shaft 60). Therefore, the main portion of each of the plate pieces 100 to 109 has a front edge, both side edges in the width direction and a central portion (existing between the holes 200 and defining a distance therebetween) in the width direction, which are continuous to each other. Both side edges in the width direction and the central portion in the width direction are continuous to the base portion on the side opposite to the front edge.

When the stirrer 58 rotates in the counterclockwise direction in FIG. 3, the flat surfaces of the paddles 90 to 99 act upon the toner 38 contained in the container 2 to stir the toner 38, so that the toner 38 existing above the portion 10 of the bottom wall is conveyed to the upper portion of the arcuate portion 8, i.e., conveyed to the portion where the conveyer 42 is disposed. That is, the paddles 90 to 99 have a semicircular shape in transverse section and their flat surfaces act upon the toner 38, and hence, the stirring function and the conveying function of the paddles in the present invention can be further enhanced compared with those of the paddles having a circular shape in transverse section. The plate pieces 100 to 109 of the paddles 90 to 99 sweep the inner surface of the portion 10 of the bottom wall of the container 2 and the inner surface of the rear wall (wall located at the left end in FIG. 3) in order to prevent the toner 38 from staying on the inner surfaces. The loci drawn by the protruding portions formed at the ends of the neighboring plate pieces overlap one upon the other. Accordingly, the plate pieces 100 to 109 act upon the inner surface of the container 2 continuously in the axial direction of the rotary shaft 60.

Two holes 200 are formed in each of the plate pieces 100 to 109. When the plate pieces 100 to 109 rotate as described above, therefore, the toner 38 passes through the holes 200, making it possible to considerably decrease a maximum required rotational torque compared with that of the conventional stirrer. Moreover, the holes 200 of the plate pieces 100 to 109 permit the toner 38 to pass through and, hence, work to loosen the masses of toner 38. Thus, the plate pieces 100 to 109 exhibit enhanced stirring ability. The plate pieces 100 to 109 each having two holes 200 exhibit enhanced function for loosening the masses of toner 38 compared with the plate pieces having only one hole 200. Besides, a portion existing between the holes 200 and defining the distance therebetween in each of the plate pieces 100 to 109, works to support the plate pieces 100 to 109. Accordingly, the plate pieces 100 to 109 are prevented from losing resiliency. (Thus, the toner 38 adhered to the portion 10 of the bottom wall and to the surfaces of the rear wall of the container can be reliably scraped up to a sufficient degree.)

The paddles 90 to 99 are disposed not at the same angular position but at ten different angular positions at an angular distance of 36 degrees relative to one another. Therefore, the paddles 90 to 99 as well as the plate pieces 200 to 209 act upon the toner 38 at angular positions different from each other and under different conditions. A relatively large resistance acts upon the paddles 90 to 99 when the flat surfaces of the paddles 90 to 99 move downwardly to downwardly force the toner 38 toward the bottom wall of the container 2, and a relatively small resistance acts upon the paddles 90 to 99 when the flat surfaces of the paddles 90 to 99 move upwardly to upwardly force the toner 38. Since the paddles 90 to 99 are disposed at ten different angular positions, the amount of change in the rotational torque required for rotating the stirrer 58 one turn becomes considerably smaller than that of when the paddles are arranged at one or two angular positions in a concentrated manner, and the required maximum torque is considerably decreaed.

As described above, the paddles 90 to 99 extend substantially in parallel with the rotary shaft 60, and the distance between the paddles 90 to 99 and the rotary shaft 60 is substantially the same. Furthermore, the paddles 90 to 99 have substantially the same length in the axial direction. Besides, the distance from the central axis of the rotary shaft 60 to the ends of the arms 68 to 87 is substantially the same. The above-mentioned constitution makes it possible to decrease the amount of change in the rotational torque required for rotating the stirrer 58 one turn and contributes to decreasing a maximum required torque.

In the foregoing was described a preferred embodiment of the toner cartridge constituted according to the present invention with reference to the accompanying drawings. It should, however, be noted that the invention is in no way limited to the above embodiment only but can be changed or modified in a variety of other ways without departing from the scope of the invention. Though the embodiment of the toner cartridge was described above in detail, the stirrer of the present invention can be used not only for stirring the toner in the toner cartridge but also for stirring the developing agent in the developing housing of a developing device and for stirring the powder in a device which deals with powder other than toner or developing agent.

In the above-mentioned embodiment, twenty arms were arranged on the rotary shaft, ten paddles were arranged between the ends of the arms, and plate pieces (a total of ten) were arranged on the paddles. The present invention, however, is in no way limited to the above embodiment only. The present invention holds even when the stirrer is provided with, for example, two arms, one paddle and one plate piece, or even when the stirrer is provided with three or more arms, two or more paddles and two or more plate pieces. The invention further holds when one or more hole is formed in the plate pieces. The number and size of the holes may be suitably determined depending upon the stiffness of the plate pieces.

What we claim is:

1. A stirrer comprising a rotary shaft, arms extending in the radial direction from said rotary shaft at a distance in the axial direction, and at least one paddle arranged between the ends of said arms, each said paddle being provided with a plate piece made of a synthetic resin film extending from said paddle in a direction to separate away from said rotary shaft, wherein said plate piece has at least one hole formed therein, and said stirrer has plural paddles, said paddles being arranged in a number of not smaller than three in a dispersed manner at least at three angular positions different from each other at a distance in the circumferential direction.

2. A stirrer according to claim 1, wherein said holes are formed in a number of two at a distance in the direction of width of said plate piece.

3. A stirrer according to claim 1, wherein said paddles extend substantially in parallel with said rotary shaft, and a distance between said paddles and said rotary shaft is substantially the same.

4. A stirrer according to claim 1, wherein said paddles have substantially the same length in said axial direction.

5. A stirrer according to claim 1, wherein said paddles are arranged at angular positions at an equal angular distance.

6. A stirrer according to claim 1, wherein said paddles have a semicircular shape in transverse section.

7. A stirrer according to claim 1, wherein said rotary shaft, said arms and said paddles are made of a synthetic resin material as a unitary structure.

8. A toner cartridge comprising a container having a toner discharge port, a toner contained in said container, and a stirrer for stirring the toner present in said container, said stirrer including a rotary shaft rotatable mounted across both side walls of said container, arms extending in the radial direction from said rotary shaft at a distance in the axial direction, and at least one paddle arranged between the ends of said arms, each said paddle being provided with a plate piece made of a synthetic resin film extending from said paddle in a direction to separate away from said rotary shaft, wherein said plate piece has at least one hole formed therein, and said stirrer has plural paddles, said paddles being arranged in a number of not smaller than three in a dispersed manner at least at three angular positions different from each other at a distance in the circumferential direction.

9. A toner cartridge according to claim 8, wherein said holes are formed in a number of two at a distance in the direction of width of said plate piece.

10. A toner cartridge according to claim 8, wherein said paddles extend substantially in parallel with said rotary shaft, and a distance between said paddles and said rotary shaft is substantially the same.

11. A toner cartridge according to claim 8, wherein said paddles have substantially the same length in said axial direction.

12. A toner cartridge according to claim 8, wherein said paddles are arranged at angular positions at an equal angular distance.

13. A toner cartridge according to claim 8, wherein said paddles have a semicircular shape in transverse section.

14. A toner cartridge according to claim 8, wherein said rotary shaft, said arms and said paddles are made of a synthetic resin material as a unitary structure.

* * * * *